US007127761B2

(12) United States Patent
Frugé

(10) Patent No.: US 7,127,761 B2
(45) **Date of Patent: *Oct. 31, 2006**

(54) MATTRESS ASSEMBLY

(75) Inventor: Larry Frugé, Carl Junction, MO (US)

(73) Assignee: L & P Property Management Company, South Gate, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/057,907

(22) Filed: Feb. 15, 2005

(65) Prior Publication Data

US 2005/0144729 A1 Jul. 7, 2005

Related U.S. Application Data

(63) Continuation of application No. 10/685,661, filed on Oct. 14, 2003, now Pat. No. 6,857,142.

(60) Provisional application No. 60/282,240, filed on Apr. 6, 2001.

(51) Int. Cl.

| | |
|---|---|
| *A47C 27/08* | (2006.01) |
| *A47C 27/00* | (2006.01) |
| *A47C 17/04* | (2006.01) |

(52) U.S. Cl. ..... 5/706

(58) Field of Classification Search ..... 5/706–719, 5/690

See application file for complete search history.

(56) References Cited

U.S. PATENT DOCUMENTS 6,317,912 B1 * 11/2001 Graebe et al. ..... 5/710

* cited by examiner

*Primary Examiner*—Alexander Grosz
(74) *Attorney, Agent, or Firm*—Shook, Hardy & Bacon L.L.P.

(57) ABSTRACT

This invention is directed to a mattress assembly. The mattress assembly has a first mattress that has an innerspring construction. Disposed above the first mattress is a second mattress that has an air bladder construction. The air bladder of the second mattress has a valve, which is located adjacent the head end of the mattress. The valve is adapted to selectively allow air into and out of the air bladder. The mattress assembly thus provides the combination of an innerspring mattress with an air mattress. The location of the valve allows the air mattress portion to be deflated properly and allows convenient access to the valve for inflation or air pressure adjustment purposes.

6 Claims, 3 Drawing Sheets

MATTRESS ASSEMBLY

CROSS-REFERENCE TO RELATED APPLICATIONS

This application is a continuation of, and claims the benefit of U.S. Pat. No. 6,857,142, issued Feb. 22, 2005, from U.S. application Ser. No. 10/685,661, filed Oct. 14, 2003, a Non-Provisional, claiming the benefit of U.S. Pat. No. 6,665,893 issued Dec. 23, 2003, claiming the benefit of U.S. Provisional Application, Ser. No. 60/282,240, filed Apr. 6, 2001, the contents of which are incorporated by reference.

STATEMENT REGARDING FEDERALLY SPONSORED RESEARCH OR DEVELOPMENT

Not Applicable.

BACKGROUND OF THE INVENTION

This invention relates generally to a mattress system, and, more particularly, to a mattress system that combines the benefits of a traditional coil mattress with the additional comfort of an air mattress for use in a sofa sleeper.

It is well known that the mattresses provided within a sofa sleeper can be uncomfortable to those sleeping thereon. This uncomfortability is, in part, a result of the space constraints existing within a sofa sleeper. In other words, the available space within a sofa sleeper for the mattress when the mattress is in a stowed condition necessitates a mattress that is relatively thin. A typical sofa sleeper mattress is used that has an inner spring coil construction. Typically, these mattresses are approximately four inches thick. When a mattress is used that is of this thickness, the person sleeping on the mattress can often feel the support structure for the mattress, such as the steel frame for the sofa sleeper. It would, therefore, be desirable to manufacture a mattress for a sofa sleeper that increased the comfort of the individual sleeping thereon. However, because it is used within a sofa sleeper, the mattress must fit within a typically dimensioned sofa sleeper unit.

Traditional sofa sleepers are designed with a folding frame mechanism that operates to stow the mattress when the unit is used as a sofa, and that is used to deploy and support the mattress when the unit is used as a sleeping surface. When the user of the bed wishes to stow the mattress, the foot portion of the bed is folded upwardly over the mattress. In this position the foot portion of the mattress is folded over the middle portion of the mattress. The end of the mattress assembly is then lifted upwardly, so that the folded-over portion of the foot as well as the middle part of the mattress is lifted. In the lifted position, the mattress assembly is moved towards the back of the sofa sleeper. The back of the mattress assembly is received within the back of the sofa frame, and the foot portion and middle portion of the mattress form the support surface for the cushions of the sofa.

In a sofa sleeper having an air mattress, it is important to properly deflate the air bladder prior to stowing the mattress within the sofa sleeper. Failure to properly deflate the air bladder will cause problems in stowage, such as a failure to completely stow the mattress assembly. In addition, the improper deflation of the air bladder can place additional and unwanted stress upon the support frame.

It is therefore an object of the present invention to provide a sofa sleeper of increased comfort through the use of a combination mattress assembly that can be easily and efficiently stored when not in use.

BRIEF SUMMARY OF THE INVENTION

This invention is directed to a mattress assembly for use in a sofa sleeper. The mattress assembly has a first mattress that has an inner-spring construction. Disposed above the first mattress is a second mattress that has an air bladder construction. The air bladder of the second mattress has a valve, which is located adjacent the head end of the mattress. The valve is adapted to selectively allow air into and out of the air bladder. The mattress assembly thus provides the combination of an innerspring mattress with an air mattress. The location of the valve allows the air mattress portion to be deflated properly and allows convenient access to the valve for inflation or air pressure adjustment purposes.

BRIEF DESCRIPTION OF THE SEVERAL VIEWS OF THE DRAWING

These and other objectives and advantages of the present invention will be more readily apparent from the following detailed description of the drawings of the preferred embodiment of the invention that are herein incorporated by reference and in which.

DETAILED DESCRIPTION OF THE INVENTION

Figure 1:
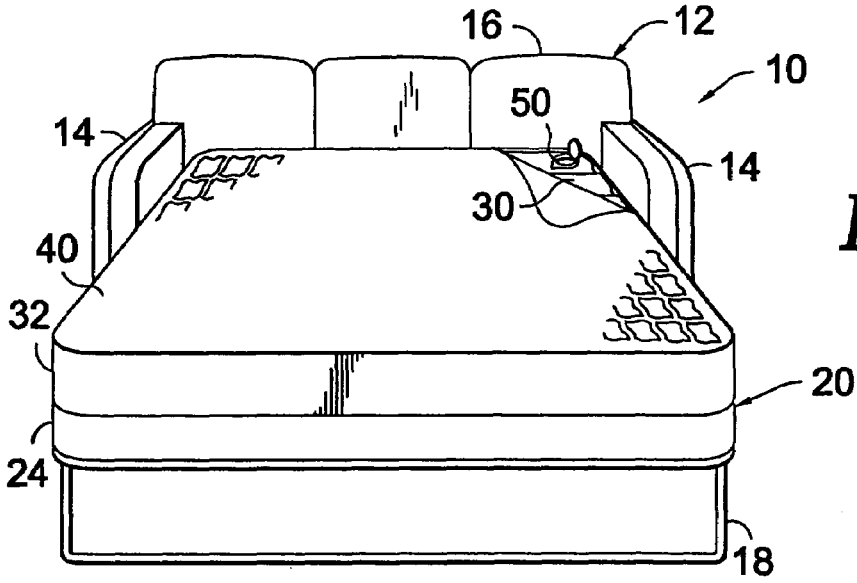
FIG. 1 is a perspective view of a sofa sleeper according to the present invention, with the mattress in the deployed position.
Figure 3:
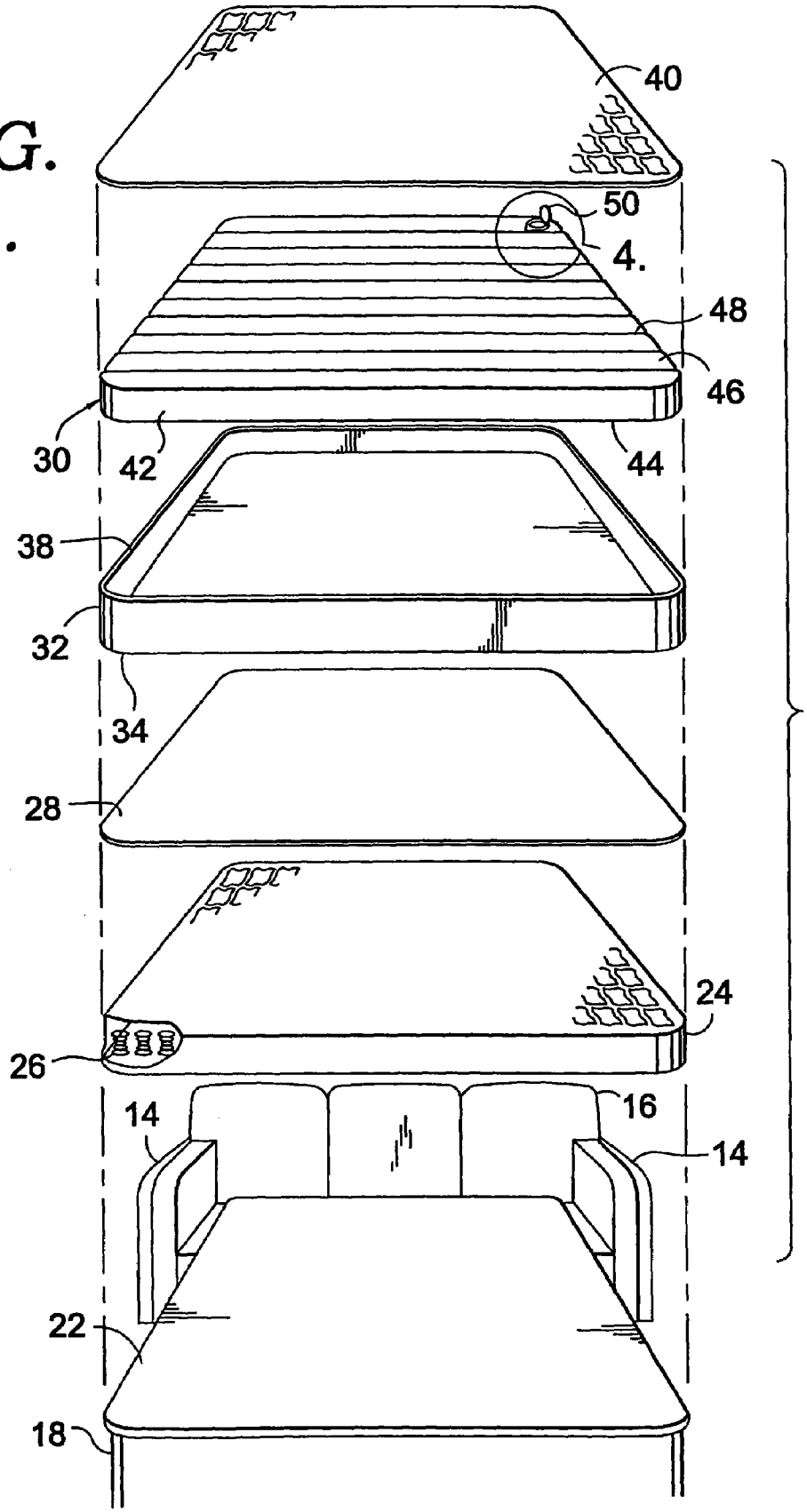
FIG. 3 is an exploded view of the mattress assembly of the sofa sleeper of FIG. 1.

With initial reference to FIG. 1, a sofa sleeper according the principles of the present invention is designated generally with the reference numeral 10. Throughout this specification, the term sofa sleeper is also intended to encompass love seats and other smaller units, such as snugglers. Sofa sleeper 10 is constructed with a sofa frame 12, which includes a pair of arms 14 and a back 16. FIG. 1 illustrates the sofa sleeper 10 in the deployed position, useful as a sleeping surface. As best seen in FIGS. 1 and 3, sofa sleeper 10 has a mattress frame mechanism 18 coupled thereto. Frame 18 is any one of a number of existing frames available and known to those of skill in the art. Frame 18 is attached to the sofa frame 12 and operates to move a mattress assembly 20 from the deployed position shown in FIG. 1 to the stored position when sofa sleeper 10 is used a sofa.

As best seen in FIG. 3, the mattress assembly 20 rests upon a support surface 22 provided as part of frame 18. As an example, support surface 22 can be provided by a number of springs attached to frame 18 and to a resilient fabric material, as is known to those of skill in the art. Mattress assembly 20 includes a lower mattress 24 that is comparable to the mattresses used within sofa sleepers in the past. As such, mattress 24 is typically about four inches in thickness. To provide support, a number of coil springs 26 are used. This type of construction is referred to as an innerspring mattress. As stated above, when mattress 24 is used alone, the mattress is readily stowed within sofa sleeper 10, but does not provide the desired level of comfort. To increase the comfort of the mattress assembly, additional components are incorporated.

With continued reference to FIG. 3, the mattress assembly 20 includes an inner panel 28. The inner panel 28 serves as a divider between the lower mattress 24 and an air bladder 30. A cover border 32 is attached on its lower edge 34 to the inner panel 28 and the lower mattress 24. Cover border 32 has a zipper attached on its upper edge 38 that is used to removably couple a top panel cover 40 to the border 32. As viewed in FIG. 2, the zipper preferably terminates in an upper corner of the mattress assembly, so that an upper corner of the bladder 30 can easily be exposed. As can be understood, the inner panel 28, cover border 32 and top panel cover 40 form a pocket to receive the bladder 30.

Air bladder 30 is thus received within the pocket formed by panel 28, cover border 32 and top panel cover 40. The zipper 36 is moved to a closed position when the bladder is completely inflated, but can be opened either partially or fully, as necessary, as is more fully described below. Air bladder 30 is preferably made from a durable, air impermeable material, such as vinyl. The vinyl side panels 42 and bottom panels 44 are typically exposed. A top surface 46 is coupled to the top of air bladder 30 and is preferably made from a fabric or material, such as a cotton surface or other flocked material. The top surface 46 will thus reduce the potential for noise when sleeping thereon, such as may be experienced if the top were made of a smooth vinyl material. Additionally, the air bladder is constructed with a series of horizontally extending indentations 48, formed in the top surface 46. Extending below each indentation 48 is a baffle element located within the air bladder. The baffles operate to properly route the air through the bladder 30, as would be understood by those of skill in the art.

Figure 4:
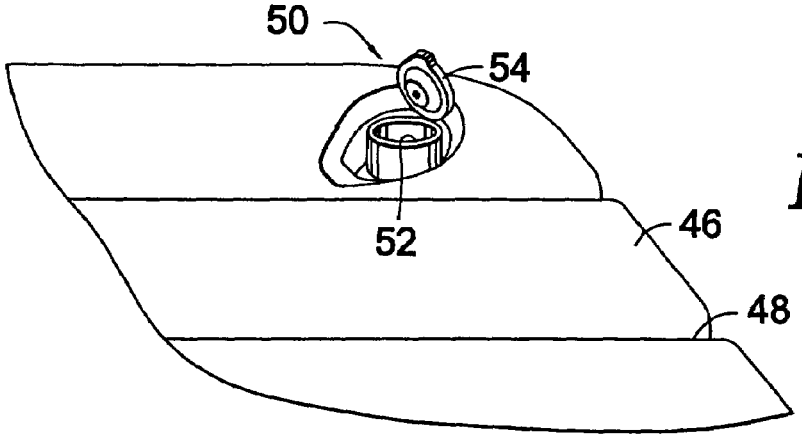
FIG. 4 is an enlarged view of the encircled region 4 of FIG. 3, showing the valve in the open position.
Figure 5:
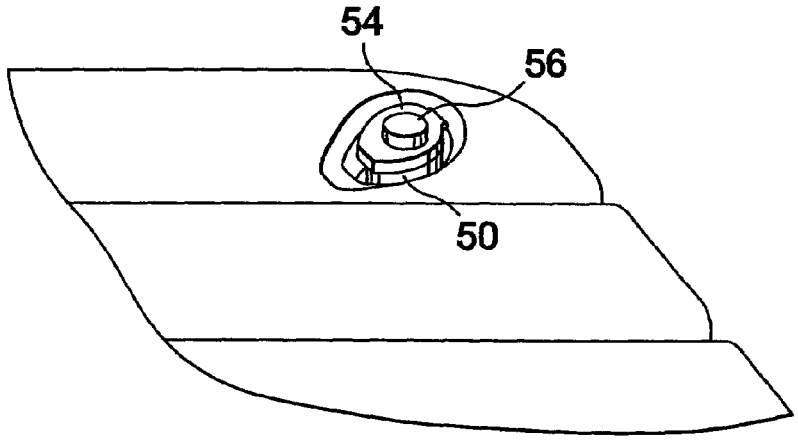
FIG. 5 is a view similar to FIG. 4, showing the valve in the closed position.
Figure 6:
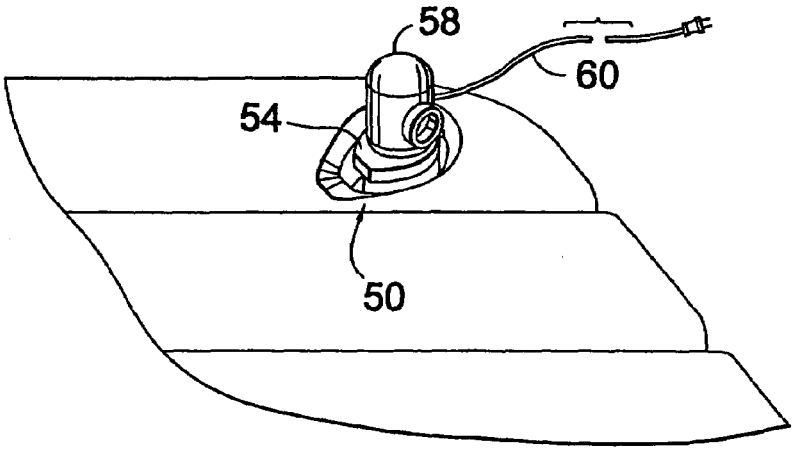
FIG. 6 is a view similar to FIGS. 4 and 5, showing an inflating pump in place over the valve.

A valve 50 is integrally formed or coupled with the bladder 30 in the upper corner thereof, as viewed in the figures. Turning to FIGS. 4–6, the valve 50 is seen in more detail. Valve 50 as a large mouth 52 that allows air to escape from bladder 30 quickly when the valve is in an open position. A top 54 is hinged to and snaps over mouth 52 to close the valve 50. The top 54 is thus moveable between the open position shown in FIG. 4 to the closed position shown in FIG. 5. The top 54 may additionally be provided with a smaller valve assembly, not shown, which can be used to release small amounts of air. This smaller valve assembly thus provides some adjustability to the firmness of the bladder 30. As shown in FIG. 5, the top 54 may also have a removable cap 56 that prevents the smaller valve assembly from inadvertent deflation of the bladder. The top 54 is also formed to accommodate an inflating pump 58 as shown in FIG. 6. Preferably, pump 58 and top 54 are made to mate with one another when the cap 56 is removed, such that when pump 58 is placed on top 54 and is engaged, the pump will activate to fill bladder 30. Pump 56 is illustrated as having a power cord 60 that supplies power to the pump. Other power supplies could also be used, such as batteries.

Figure 2:
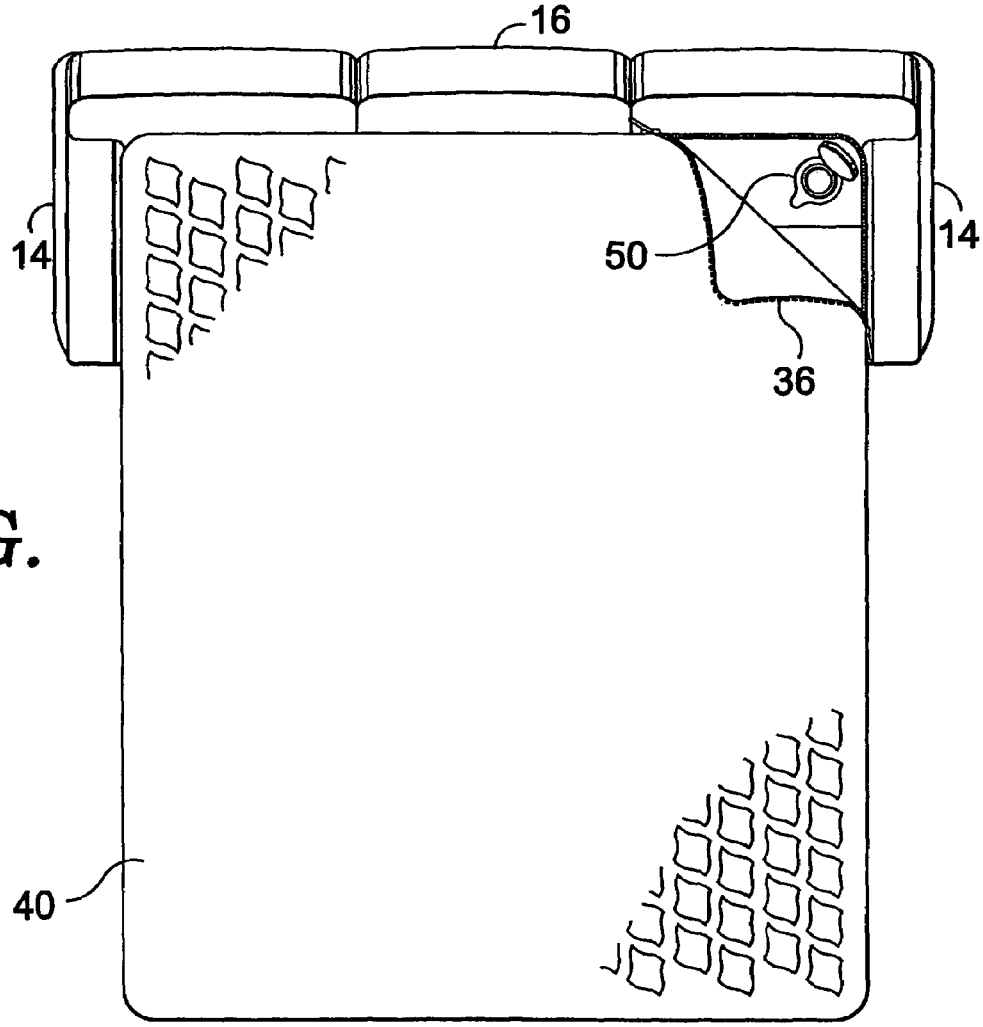
FIG. 2 is a top plan view of the sofa sleeper of FIG. 1.

To place the sofa sleeper 10 in a position for sleeping, the cushions of the sofa are removed and the frame 18 is pulled from the sofa cavity and unfolded into the position shown in FIG. 3. In this position, the bladder 30 is still in the deflated condition. The zipper 36 is then used to expose valve 50, as shown in FIGS. 1 and 2. The cap 56 is removed from the top 54 and the pump 58 is engaged with the top, as shown in FIG. 6. The engagement of the pump with the top causes the pump to fill the bladder 30 with air. When the bladder 30 is filled with an amount of air suitable to the comfort needs of the user, the pump 58 is disengaged from top 54 and the cap 56 is replaced on top 54. The top panel cover is then re-zipped to hide the valve 50. The sofa sleeper in this position is ready for sleeping. The additional support provided by the bladder 30 within the mattress assembly 20 increases the overall comfort of those sleeping upon the sofa sleeper. Moreover, the top surface of the bladder 30 reduces any noise associated with the material of the bladder.

When the mattress assembly 20 is to be stowed within sofa sleeper 10, the zipper is used to expose valve 50. The top 54 of the valve is then opened, allowing air to escape from the bladder 30 through mouth 52. The large opening allows air to rapidly escape from the bladder. The removal of air is furthered by the positioning of the valve and the operation of the frame 18. More specifically, after valve 50 is opened, the foot end of frame 18 is folded upwardly and inwardly, as with a traditional sofa sleeper mechanism. The foot end is folded over, so that the foot end portion of the mattress assembly rests on the middle portion of the mattress assembly. This folding operation results in air being "squeezed out" of the bladder 30, pushing the air towards valve 50 and out mouth 52. The frame 18 is then moved into the stowed position, which pushes any remaining air out of the bladder 30. The positioning of valve 50 therefore reduces the likelihood that any significant amount of air will remain within bladder 30 when the mattress assembly 20 is moved to a stowed position. Therefore, the likelihood that the mattress assembly will not stow properly, or that any damage will be done to mattress frame 18 is also reduced. If the valve were placed in an area other than the head end of the bed, such as at the foot of the bed, the likelihood of improper deflation increases.

Should the bladder ever need replacement or repair, the zipper 36 allows full and easy access to the bladder without damaging the mattress assembly in any way. Zipper 36 also provides easy access to the valve 50 for any necessary operations, such as opening and closing the valve and making pressure adjustments to the air bladder 50.

The present invention has been described in relation to particular embodiments, which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated and with the scope of the claims.

What is claimed is:

1. A mattress assembly comprising:

a first mattress having an innerspring construction;

a second mattress having an air bladder therein, the second mattress disposed on top of the first mattress, the first and second mattresses each having a head end and a foot end, the second mattress including:

a cover border coupled to an edge of the first mattress and extending upwardly therefrom; and a top cover removably coupled to the cover border, the top cover and cover border forming a cavity for receipt of the air bladder; and a valve adapted to selectively allow air into and out of the air bladder, wherein the top cover selectively exposes the valve for operations thereon.

2. The mattress assembly of claim 1, wherein a top surface of the air bladder is made from a noise-reducing material.

3. The mattress assembly of claim 1, wherein the top cover is coupled to the cover border with a zipper extending substantially all the way around the top edge of the cover border.

4. A mattress assembly comprising:

a first mattress having an innerspring construction;

a second mattress having an air bladder therein, the second mattress disposed on top of the first mattress, the first and second mattresses each having a head end and a foot end, the second mattress including:

an inner panel coupled to an edge of the first mattress;

a cover border coupled to an edge of the inner panel and extending upwardly therefrom; and a top cover removably coupled to the cover border, the top cover, inner panel, and cover border forming a cavity for receipt of the air bladder; and a valve adapted to selectively allow air into and out of the air bladder, the valve being coupled to the air bladder on the second mattress and located adjacent the head end of the second mattress, wherein the top cover selectively exposes the valve for operations thereon.

5. The mattress assembly of claim 4, wherein a top surface of the air bladder is made from a noise-reducing material.

6. The mattress assembly of claim 5, wherein the top cover is coupled to the cover border with a zipper extending substantially all the way around the top edge of the cover border.

* * * * *